US008857308B1

(12) United States Patent
Kurowsky et al.

(10) Patent No.: US 8,857,308 B1
(45) Date of Patent: Oct. 14, 2014

(54) CANNON BREECHBLOCK INSERT ASSEMBLY

(71) Applicants: Joseph Kurowsky, Rensselaer, NY (US); Nicholas Morrell, III, Albany, NY (US); Alan Ng, Albany, NY (US); Adam Blot, Schenectady, NY (US)

(72) Inventors: Joseph Kurowsky, Rensselaer, NY (US); Nicholas Morrell, III, Albany, NY (US); Alan Ng, Albany, NY (US); Adam Blot, Schenectady, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/772,727

(22) Filed: Feb. 21, 2013

(51) Int. Cl.
*F41A 3/10* (2006.01)

(52) U.S. Cl.
CPC ..... *F41A 3/10* (2013.01)
USPC ..... 89/24

(58) Field of Classification Search
CPC ..... F41A 3/00; F41A 3/02; F41A 3/10; F41A 19/58; F41A 19/69; F41A 19/70
USPC ..... 89/22, 17, 24, 28.05
See application file for complete search history.

(56) References Cited

U.S. PATENT DOCUMENTS 4,329,908 A * 5/1982 Rowlands ..... 89/24
5,233,902 A * 8/1993 Bernardes ..... 89/8

* cited by examiner

*Primary Examiner* — Jonathan C Weber
(74) *Attorney, Agent, or Firm* — Michael C. Sachs

(57) ABSTRACT

A sliding breechblock for a cannon includes a translatable, removable insert assembly that contains electrical firing pin and data link modules. The removable insert assembly is translatable in a direction normal to the central longitudinal axis of the barrel thereby enabling removal of the insert assembly without removing the breechblock from the breech ring. Mating portions formed on the breechblock and on the insert assembly prevent displacement of the insert assembly with respect to the breechblock in the direction along the central longitudinal axis of the barrel.

20 Claims, 14 Drawing Sheets

CANNON BREECHBLOCK INSERT ASSEMBLY

STATEMENT OF GOVERNMENT INTEREST

The inventions described herein may be manufactured, used and licensed by or for the United States Government.

BACKGROUND OF THE INVENTION

The invention relates in general to munitions and in particular to firing and data link interconnections for cannon-fired munitions.

Internally-controlled or "smart" munitions have been used for over twenty-five years. Smart munitions launched by cannons have been in development for about five years. Cannon-launched smart munitions may be, for example, 105 mm cartridge case rounds, 120 mm metal stub base/consumable case rounds, or other rounds fitted with contact rings on their breechblock contacting surfaces. In cannons, the traditional firing circuit and breechblock geometry to support the rear quarter access of the firing circuit is over fifty years old.

Cannon-launched rounds may be electrically fired. That is, an electrical contact on the breechblock of the cannon makes contact with the firing plug on the primer of the round. An electrical current is applied to the primer, creating a spark to ignite the black powder, which ignites the propellant located in the round. A data link, for example, a Universal Munition Data Link (UMDL), can support bi-directional communication and transmission of power to some cannon-launched rounds using a set of two pins. Known cannons that launch smart munitions may use UMDL pins and circuits that are packaged separately and independent of the legacy firing circuit. Legacy firing circuits require breechblocks with relatively complex machined geometry. This geometry may include deeply drilled, tight tolerance (<0.002 inches) holes.

Known smart munitions, such as air-launched missiles and bombs, receive fire control instructions via an electrical cable with a quick-disconnect interconnection that disconnects when the smart munition is launched. The electrical cable (data link) supports electrical power transmission and bi-directional communications for the smart round. However, the design of both smart rounds and cannons do not support the quick-disconnect electrical cable type of interface. It may be possible to wirelessly communicate between the cannon and a smart round, but there are major disadvantages, such as external signal jamming, signal attenuation due to the large mass of the metal cannon surrounding the smart round, and the inability to support the power needs of the smart munition.

Traditional cannon firing circuits utilize complicated links and cams to actuate the firing pin that is in contact with the firing plug on the primer of a round. These firing circuits require extensive slots and cuts in the breechblock, which reduce the structural integrity and fatigue life of the breechblock and introduce numerous tightly toleranced linkage components. If a method similar to the traditional firing circuit were used for a cannon data link device, the resulting circuit would add many slots and cuts to the breechblock. As a result, the breechblock may not function as a part of the pressure vessel of the cannon. In addition, maintenance of the firing circuit, especially the firing pin, is a frequently performed procedure. In known firing circuits, there is no easy access to the firing pin cavity in the front of the breechblock.

SUMMARY OF INVENTION

One aspect of the invention is a breech assembly for a cannon. The cannon has a barrel with a central longitudinal axis and a breech ring fixed to one end of the barrel. The breech assembly includes a sliding breechblock disposed in the breech ring and translatable in the breech ring in a direction normal to the central longitudinal axis of the barrel. An insert assembly is disposed on a muzzle side of the breechblock and translatable in the breechblock in the direction normal to the central longitudinal axis.

The insert assembly includes a muzzle side, a breech side, and at least one electrical pin module. The insert assembly is removable from the breechblock without removing the breechblock from the breech ring. Mating portions formed on the breechblock and on the insert assembly prevent displacement of the insert assembly with respect to the breechblock in a direction along the central longitudinal axis of the barrel. The mating portions may include slots and rails that are parallel to the direction normal to the central longitudinal axis. The slots may be formed in the breechblock and the rails may be formed on the insert assembly.

The at least one electrical pin module may include a firing pin module and at least one data link module. In an installed position of the insert assembly in the breechblock, the firing pin module may be substantially coaxial with the central longitudinal axis of the barrel. The at least one electrical pin module may include a forward contact biased outwardly through the muzzle side of the insert assembly and a corresponding rear contact biased outwardly through the breech side of the insert assembly. The at least one electrical pin module may include a double-acting spring disposed between the forward and rear contacts. The insert assembly may include a removable cover on the breech side and the rear contacts may penetrate the removable cover.

At least one threaded fastener may fix the insert assembly in the breechblock. The at least one threaded fastener may displace the insert assembly from the breechblock when the fastener is rotated opposite to the fixing direction.

Electrical contacts on the muzzle side of the breechblock may electrically connect with the firing pin module and the at least one data link module, in an installed position of the insert assembly in the breechblock. A flexible circuit board may contain the electrical contacts.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel cannon breechblock insert assembly uniquely packages the firing circuitry and data link circuitry in an easily removable block for maintenance, cleaning, and replacement. The data link circuitry may include, for example, a Universal Munition Data Link (UMDL). Compared to conventional breechblocks, the novel breechblock: 1) has reduced stress-inducing machined features, thereby increasing the fatigue life of the breechblock; 2) has fewer deep, tight tolerance holes, thereby reducing the machining time and the cost of manufacturing the breechblock; 3) enables removal of the breechblock insert assembly in either the open or closed position of the breechblock; 4) enables quicker access to the firing pin and data link pins for maintenance and replacement procedures; 5) includes hardened pin tips that are in continuous contact with both the base of the cannon round and the breechblock using a spring-loaded translation; 6) accommodates various mechanisms to keep the cannon round from falling back out of the cannon tube chamber after loading; and 7) is expandable so that additional data link circuits may be added for future munition upgrades.

The novel breechblock insert assembly bundles together a data link device (for example, a UMDL) and a cannon's firing circuits into an easily removable part. The UMDL facilitates data and power transmission with the smart munition using the same set of two pins. The firing circuit allows for power to be applied to the primer of the smart munition. The insert assembly may be used for different caliber cannons, breechblock configurations, and munition requirements.

Figure 1:
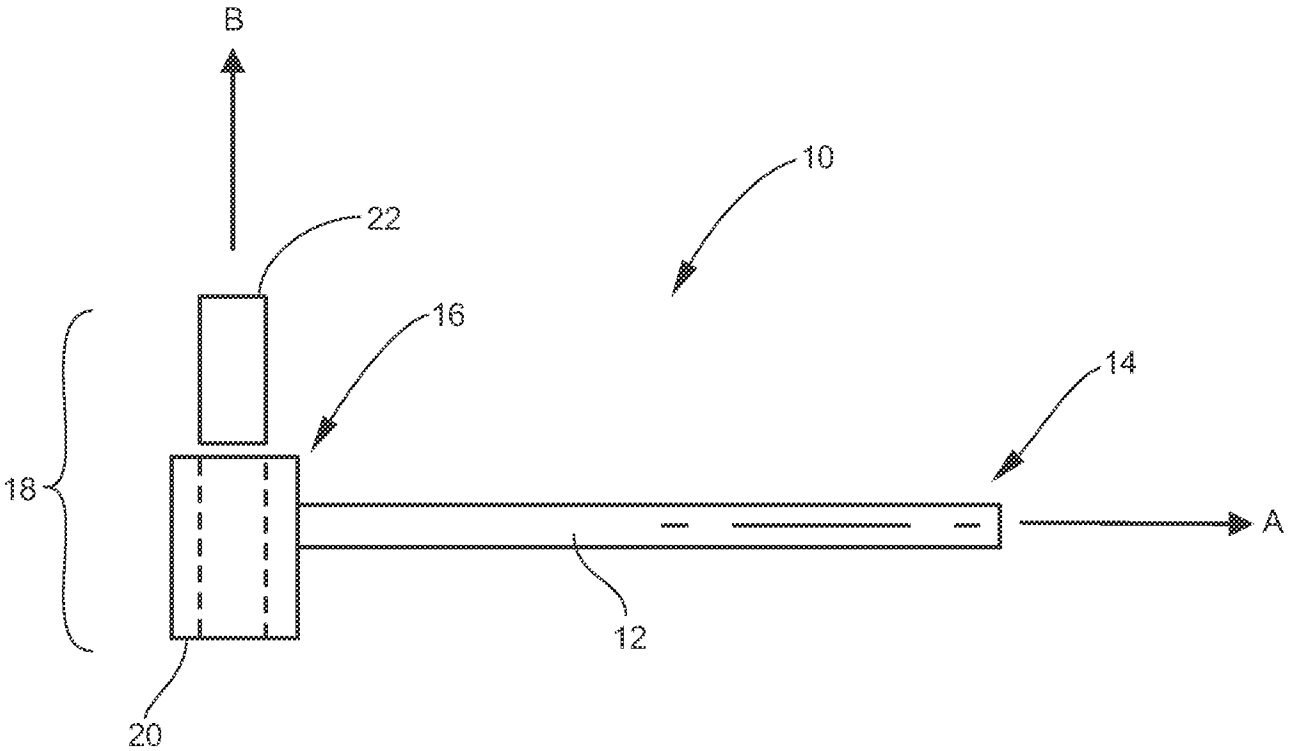
FIG. 1 is a simplified schematic view of a cannon.

FIG. 1 is a simplified schematic view of a cannon 10, for example, a large caliber cannon such as a 120 mm cannon. Cannon 10 includes a gun tube or barrel 12 having a muzzle or forward end 14 and a breech or rear end 16. Barrel 12 has a central longitudinal axis A. Cannon 10 includes a breech assembly 18 with a breech ring 20 fixed to the rear of barrel 12 and a sliding breechblock 22 that is translatable in breech ring 20. Sliding breechblock 22 is translatable in breech ring 20 along an axis B that is perpendicular to axis A.

Figure 2:
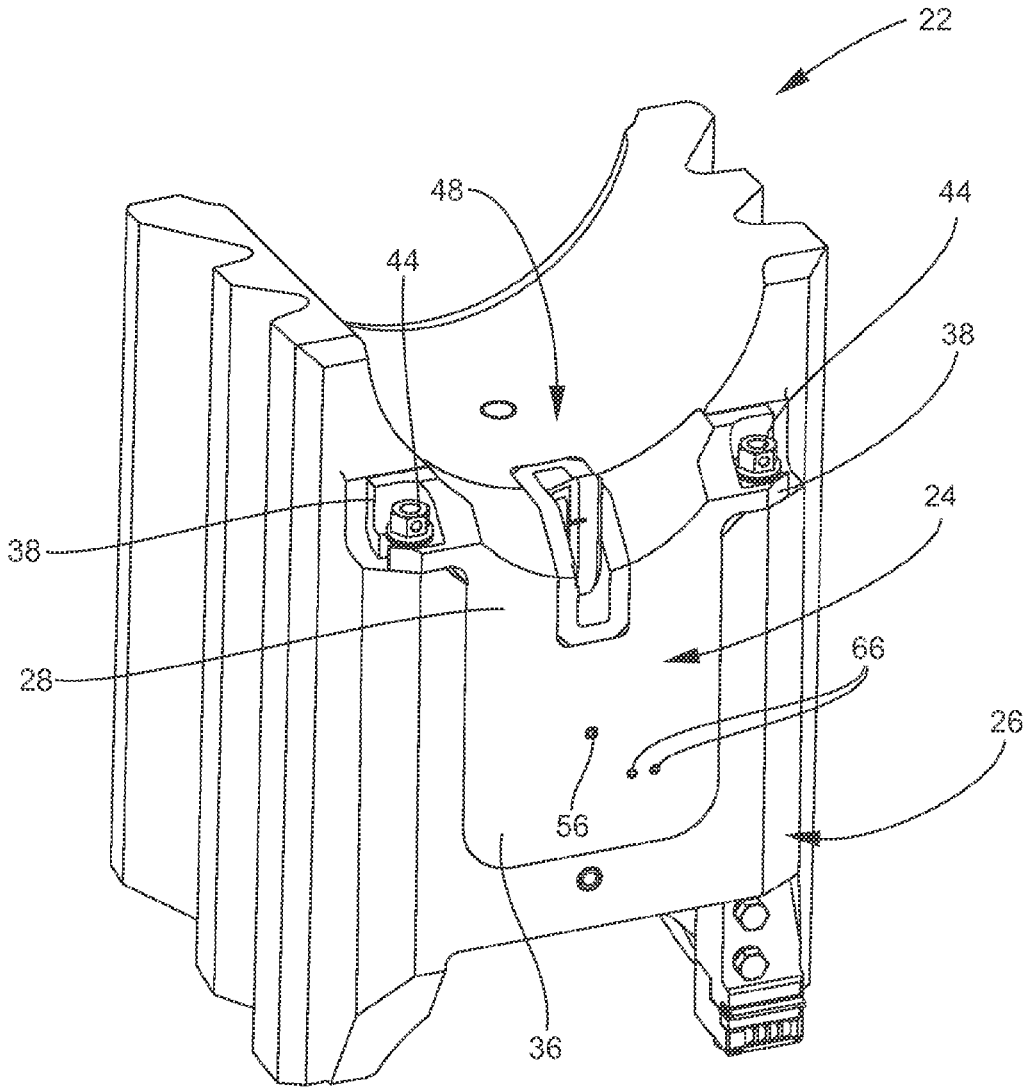
FIG. 2 is a front perspective view of one embodiment of a sliding breechblock with a removable insert assembly.
Figure 3:
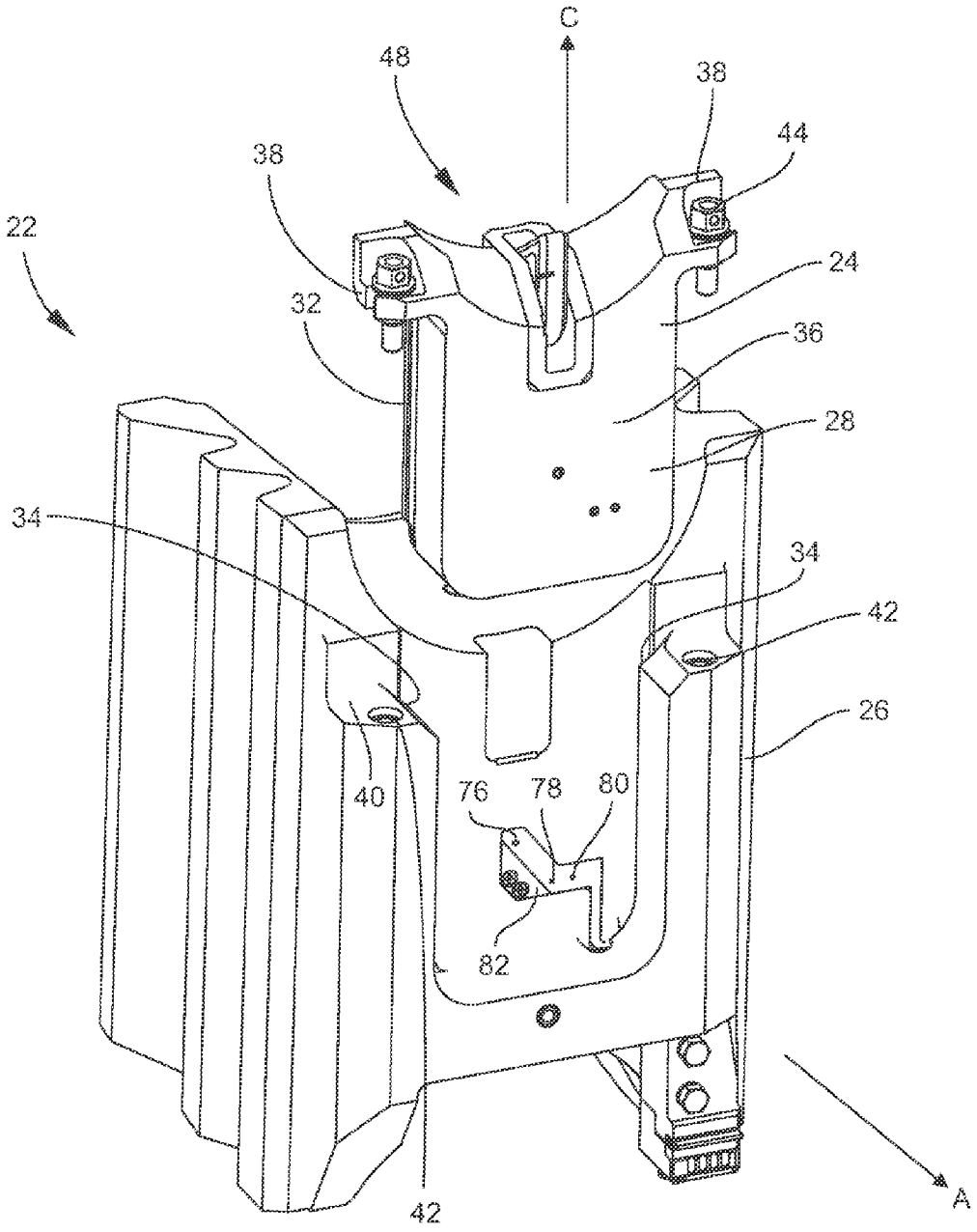
FIG. 3 shows the breechblock of FIG. 2 with the insert assembly removed from the breechblock.
Figure 4:
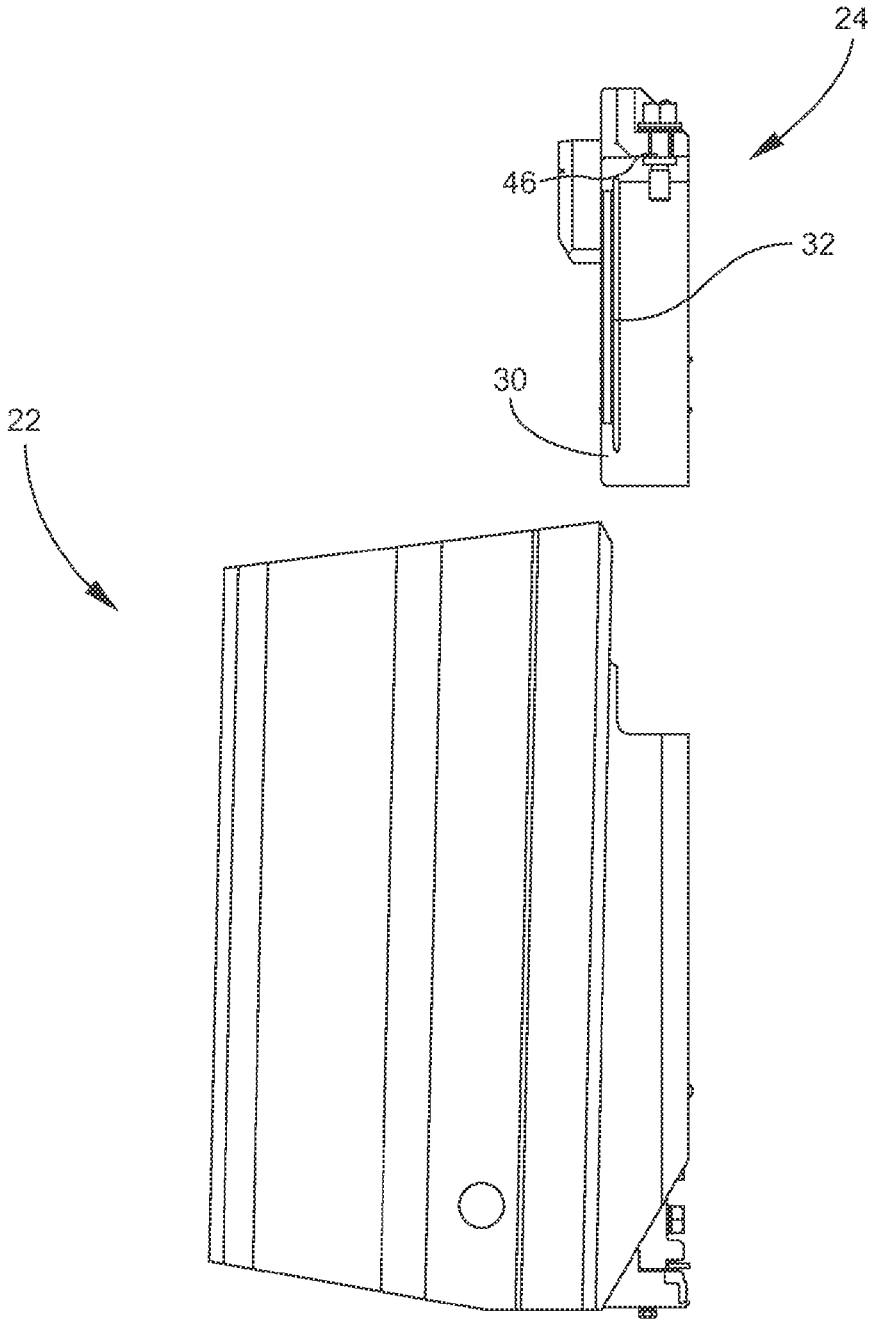
FIG. 4 is a side view of the breechblock of FIG. 2 with the insert assembly removed from the breechblock.

FIG. 2 is a front perspective view of one embodiment of sliding breechblock 22 with a removable insert assembly 24. FIG. 3 shows breechblock 22 with insert assembly 24 removed from breechblock 22. FIG. 4 is a side view of breechblock 22 with insert assembly 24 removed. Insert assembly 24 is disposed on a muzzle side 26 of breechblock 22. Insert assembly 24 is translatable in breechblock 22 along an axis C (FIG. 3) that is parallel to axis B and normal to central longitudinal axis A. Insert assembly 24 includes a muzzle side 28 and a breech side 30. Insert assembly 24 is removable from breechblock 22 without removing breechblock 22 from breech ring 20.

Insert assembly 24 includes a main body 36. Body 36 is generally solid and is made of, for example, a heat-treated steel alloy. A pair of projections or ears 38 may extend from body 36. Threaded fasteners 44 may extend through ears 38 and into threaded openings 42 (FIG. 3) on shoulders 40 of breechblock 22 to secure insert assembly 24 to breechblock 22. Fasteners 44 may include flanges 46 (FIG. 4). To loosen insert assembly 24 from breechblock 22, fasteners 44 may be rotated opposite the tightening direction so that flanges 46 bear on undersides of ears 38 and pull insert assembly 24 upward along axis C.

Mating portions are formed on breechblock 22 and on insert assembly 24 to prevent displacement of insert assembly 24 with respect to breechblock 22 in a direction along central longitudinal axis A. In the embodiment shown, the mating portions on insert assembly 24 are opposing rails 32 (FIG. 3) and the mating portions on breechblock 22 are opposing slots 34. When insert assembly 24 is installed in breechblock 22, as in FIG. 2, rails 32 slide into and nest in slots 34, thereby preventing movement of insert assembly 24 in breechblock 22 along axis A. Slots 34 and rails 32 are parallel to axes B and C.

If cannon 10 uses an autoloader, a cartridge catch mechanism 48 may be included to prevent loaded rounds from backing out of barrel 12 in elevated positions.

Figure 7:
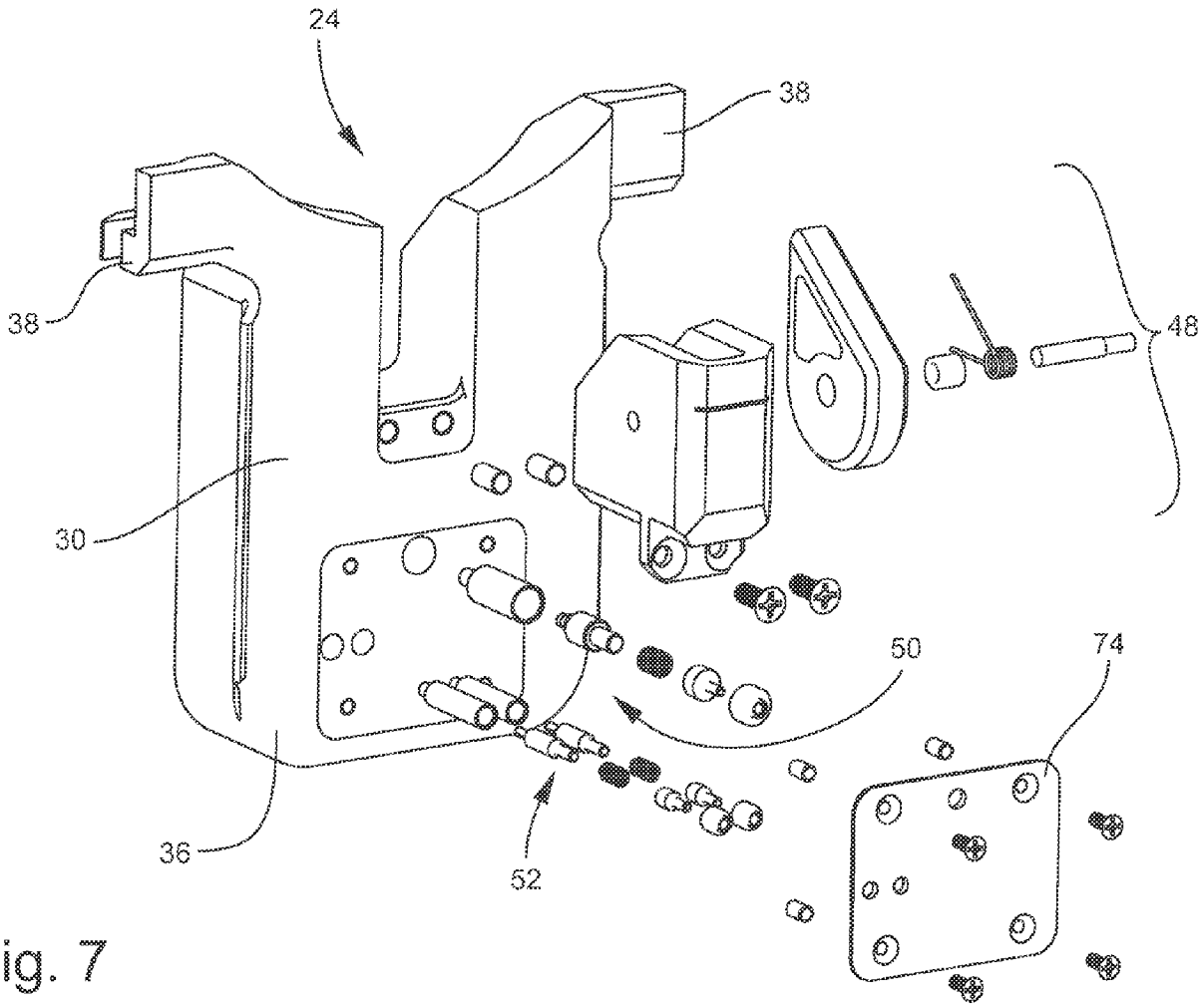
FIG. 7 is an exploded view of FIG. 6.

The interior of insert assembly 24 includes at least one electrical pin module. In the embodiment of FIG. 7, three electric pin modules are shown in exploded view. The three modules are a firing pin module 50 and two data link modules 52. The components of firing pin module 50 are shown in detail in FIG. 8 and include a forward insulator 54, a forward firing pin contact 56, a double-acting spring 58, a rear firing pin contact 60, and a rear insulator 62. The components of data link modules 52 are shown in detail in FIG. 9 and include a forward insulator 64, a forward data link contact 66, a double-acting spring 68, a rear data link contact 70, and a rear insulator 72. Firing pin and data link modules 50, 52 may be accessed by removing insert assembly 24 from breechblock 22 and then removing rear cover 74 (FIG. 7) from insert assembly 24.

Figure 5:
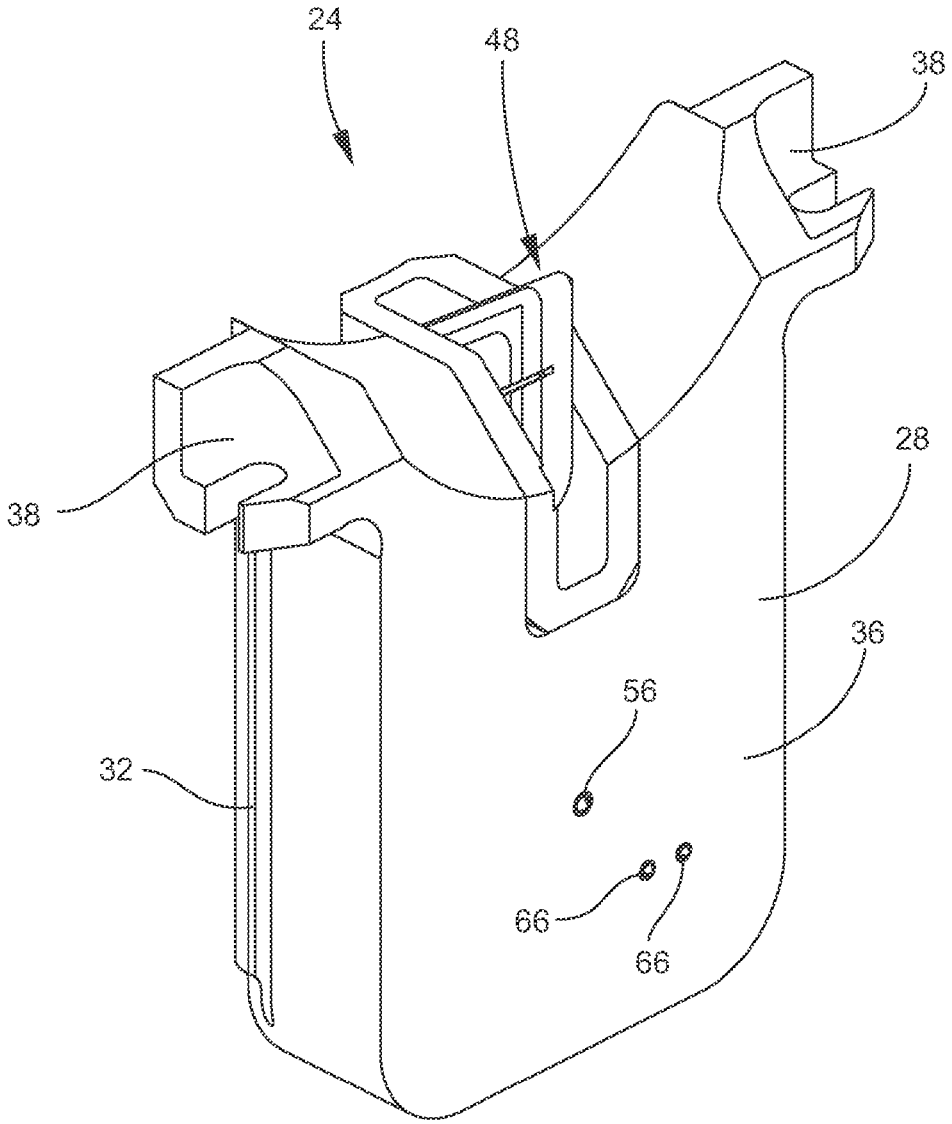
FIG. 5 is a front perspective view of one embodiment of an insert assembly for a breechblock.

Firing pin module 50 transfers electrical power from a contact 76 (FIG. 3) in breechblock 22 to the primer of a round loaded in barrel 12 to thereby ignite the primer and fire the round. Thus, forward firing pin contact 56 must be located in insert assembly 24 so that contact 56 contacts the primer of the round that has been loaded in barrel 12. Forward firing pin contact 56 is substantially coaxial with central longitudinal axis A of barrel 12. As seen in FIGS. 2 and 5, forward firing pin contact 56 is biased forward (by spring 58 of FIG. 8) through forward side 28 of insert assembly 22.

Data link modules 52 allow for data and power transmission from contacts 78, 80 (FIG. 3) in breechblock 22 to contacts on the base of a round loaded in barrel 12. The contacts on the base of the round may be in the form of, for example, concentric rings. The electrical power and electrical data signals transferred through data link modules 52 may be required for a round that is a smart munition. As seen in FIGS. 2 and 5, forward data link contacts 66 are biased forward (by spring 68 of FIG. 9) through muzzle side 28 of insert assembly 22.

Figure 6:
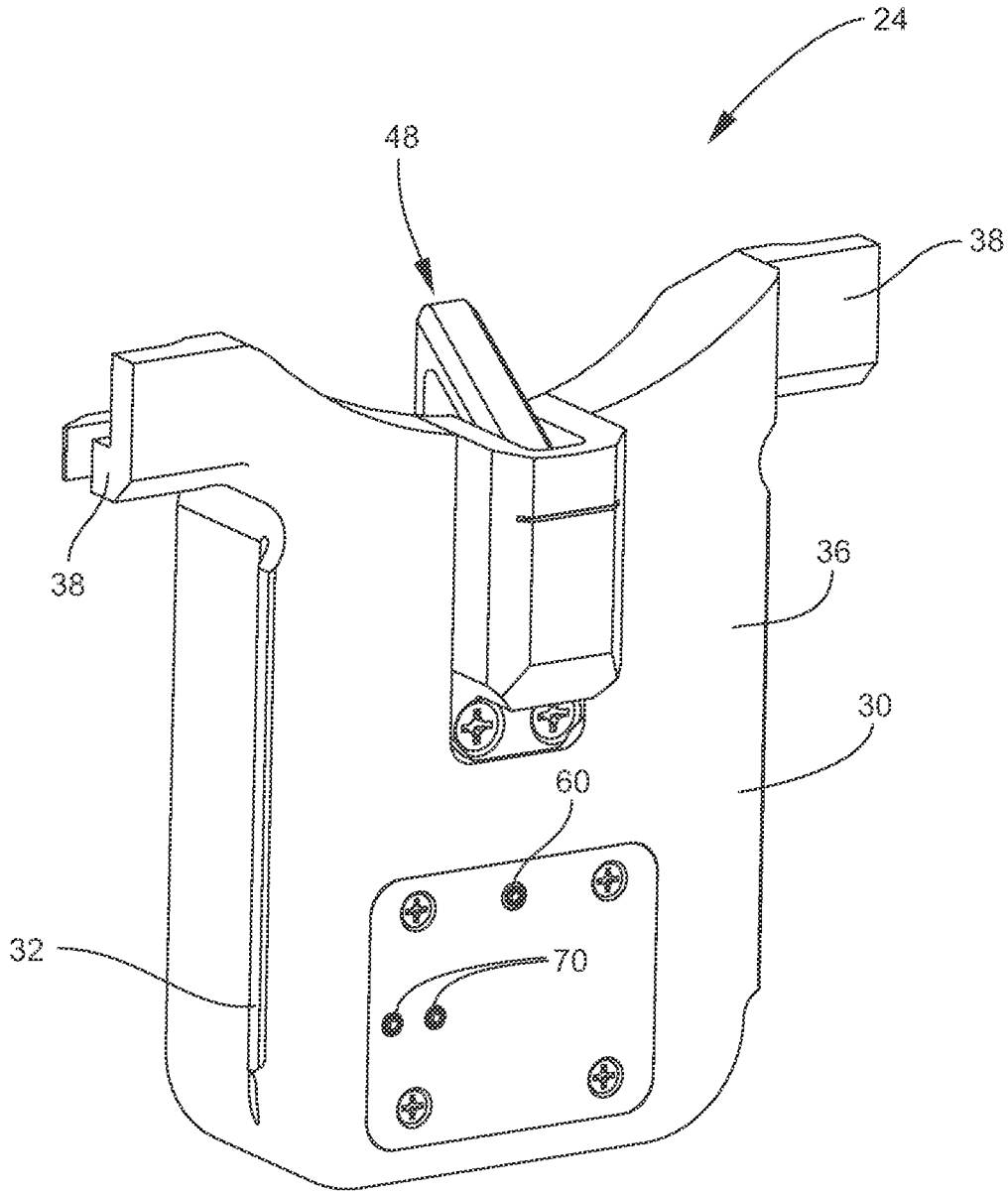
FIG. 6 is a rear perspective view of the insert assembly of FIG. 5.
Figure 8:
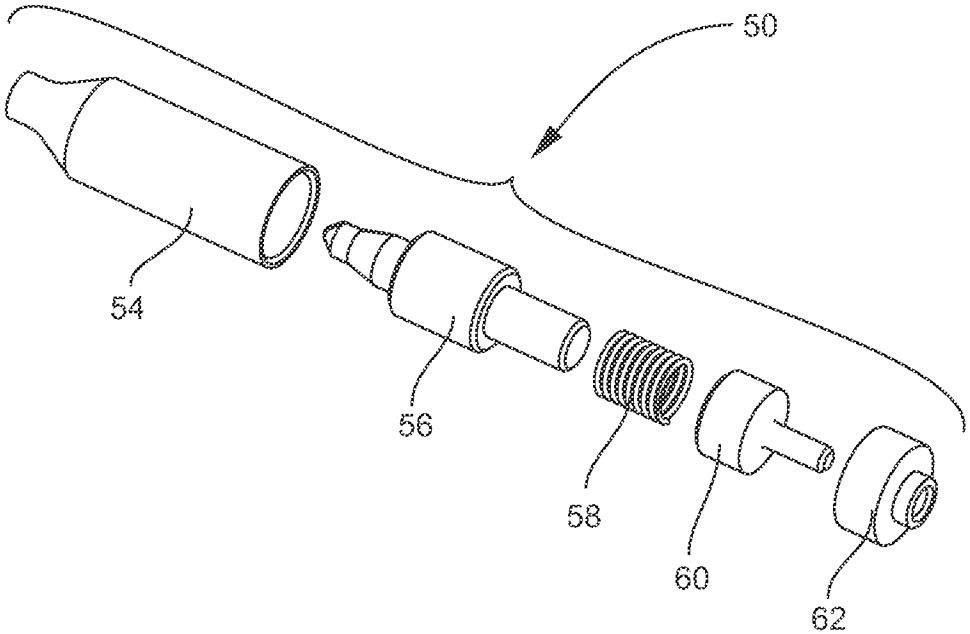
FIG. 8 is an exploded view of a firing pin module.
Figure 9:
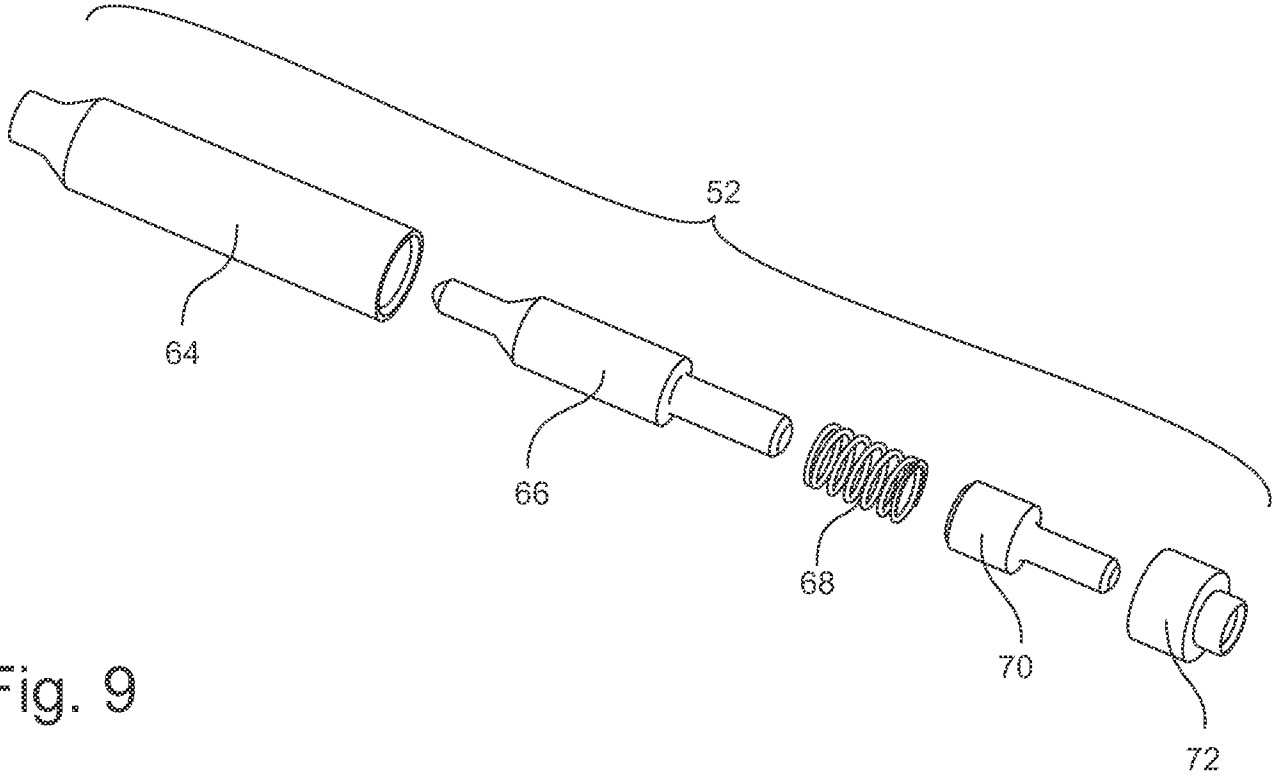
FIG. 9 is an exploded view of a data link module.

As shown in FIG. 3, breechblock 22 includes electrical contacts 76, 78, 80 that interconnect with firing pin module 50 and data link modules 52 when insert assembly 24 is in the installed position of FIG. 2. Contacts 76, 78, 80 may be part of a flexible circuit board 82. Firing circuit contact 76 interconnects with rear firing pin contact 60 (FIGS. 6 and 8) of firing pin module 50. Rear firing pin contact 60 is biased through rear cover 74 by spring 58 (FIG. 8). Data link contacts 78, 80 interconnect with rear data link contacts 70 (FIGS. 6 and 9) of data link modules 52. Rear data link contacts 70 are biased through rear cover 74 by spring 68 (FIG. 9). The electrical wiring from contacts 76, 78, 80 may be routed through breechblock 22 in any convenient manner.

Figure 10:
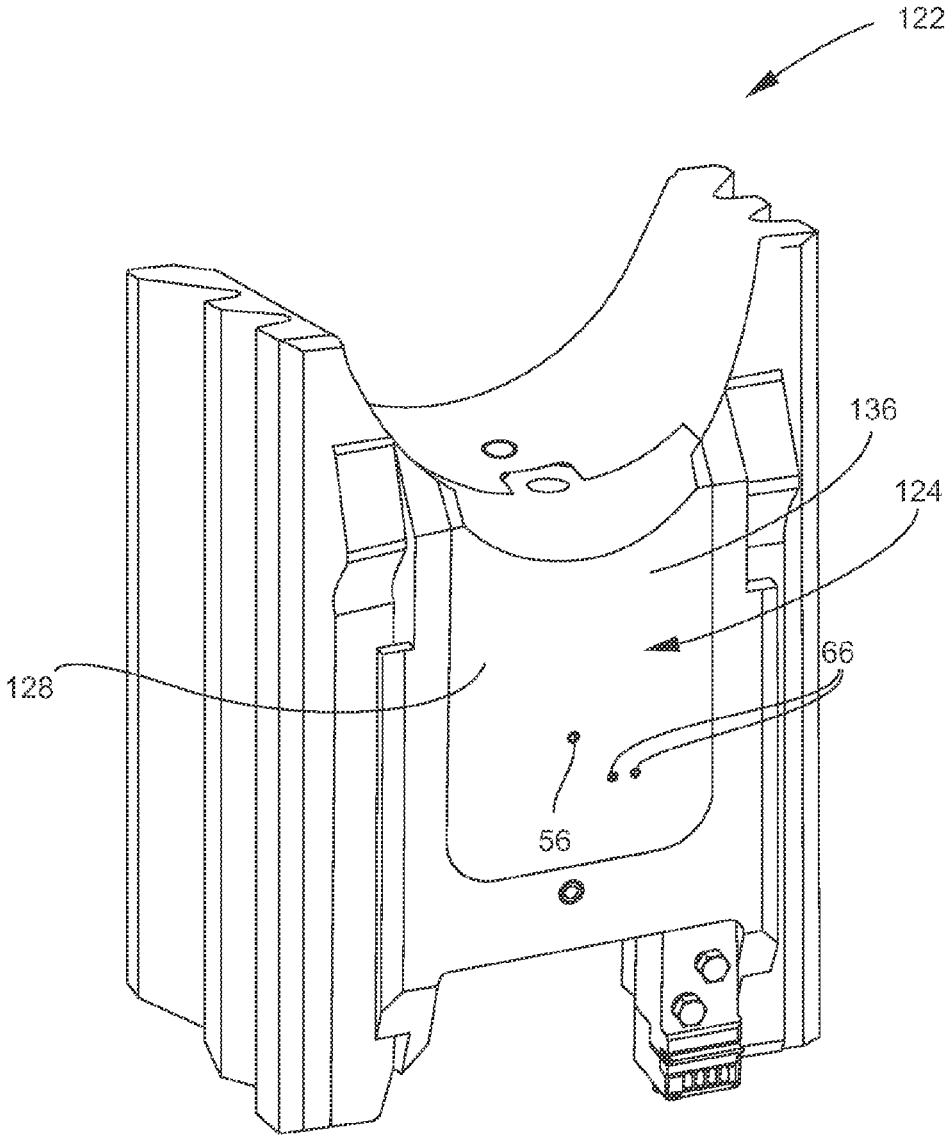
FIG. 10 is a front perspective view of another embodiment of a sliding breechblock with a removable insert assembly.
Figure 11:
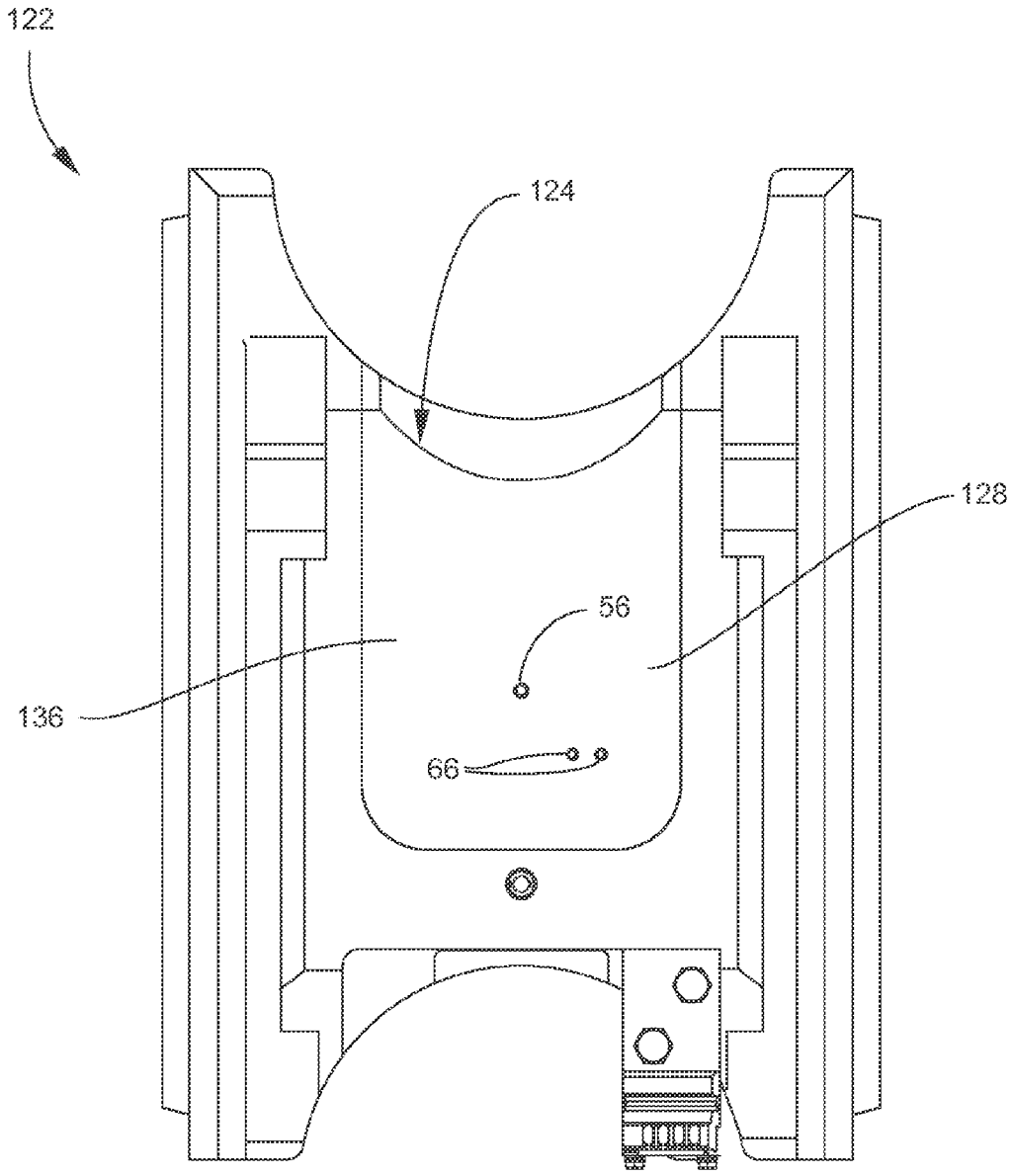
FIG. 11 is a front view of the breechblock of FIG. 10.
Figure 12:
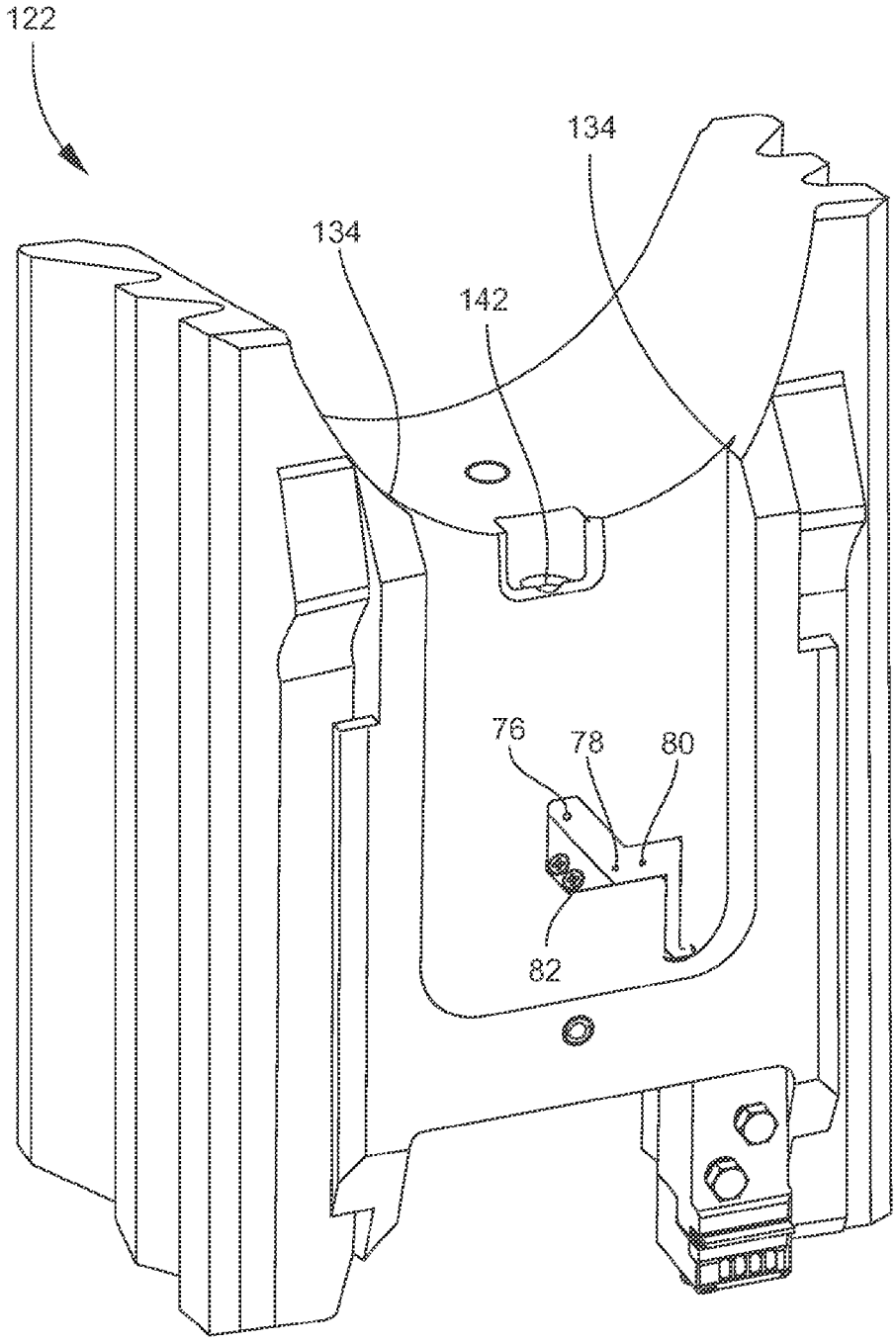
FIG. 12 shows the breechblock of FIG. 10 with the insert assembly removed.
Figure 14:
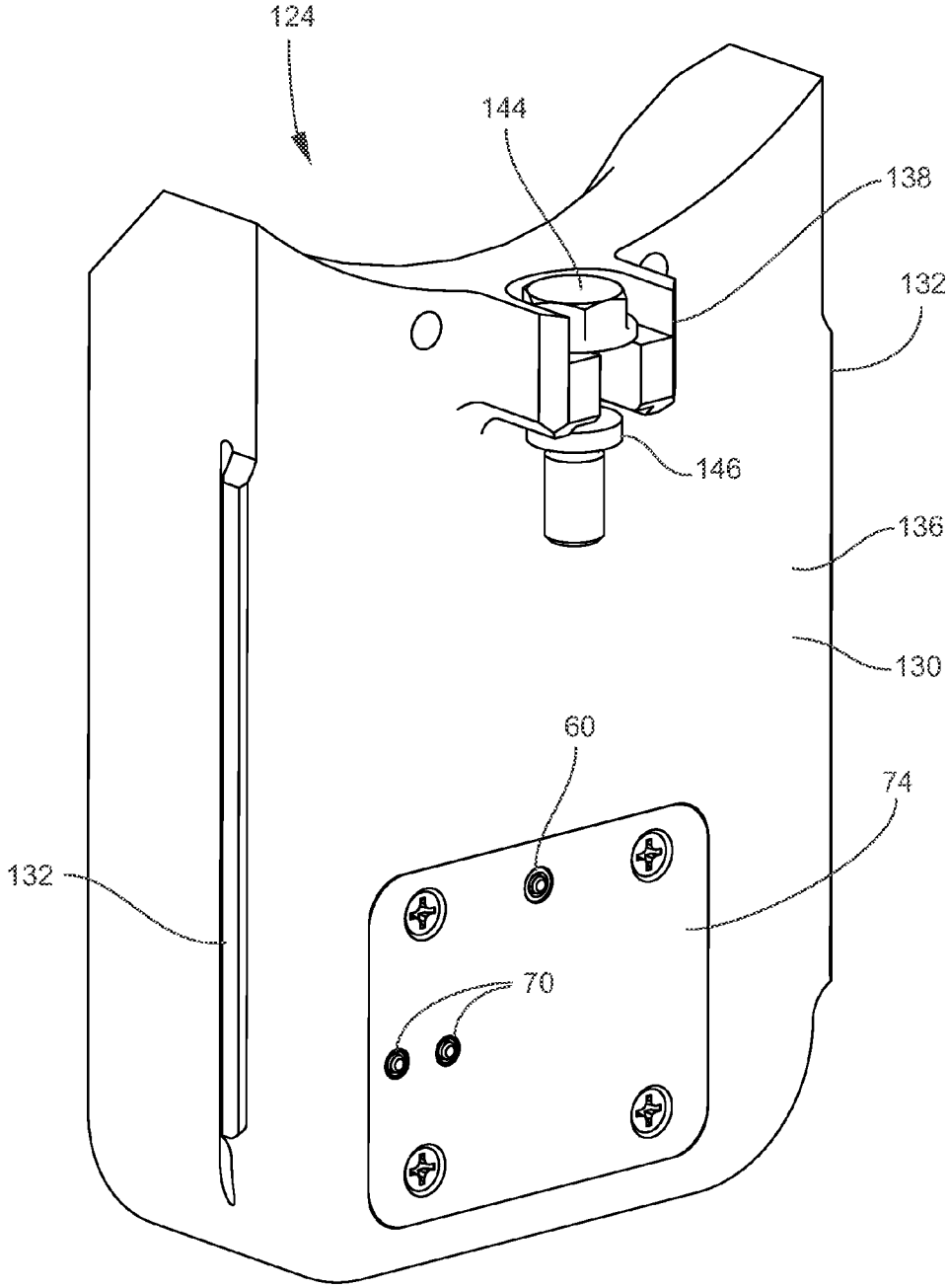
FIG. 14 is a rear perspective view of the insert assembly of FIG. 10.

FIG. 10 is a front perspective view of another embodiment of a sliding breechblock 122 with a removable insert assembly 124. FIG. 11 is a front view of breechblock 122 and FIG. 12 shows breechblock 122 with insert assembly 124 removed. Breechblock 122 and insert assembly 124 are very similar to breechblock 22 and insert assembly 24. The primary difference between breechblocks 22 and 122 is the manner in which the insert assemblies are fixed to the breechblocks. As best seen in FIG. 14, insert assembly 124 has a single projection or ear 138 through which a threaded fastener 144 passes. Fastener 144 fixes insert assembly 124 to breechblock 122 via threaded opening 142 (FIG. 12) in breechblock 122. Similar to fasteners 44, fastener 144 includes a flange 146 (FIG. 14). To loosen insert assembly 144 from breechblock 122, fastener 144 may be rotated opposite the tightening direction so that flange 146 bears on underside of ear 138 and pushes insert assembly 124 upward along axis C.

Figure 13:
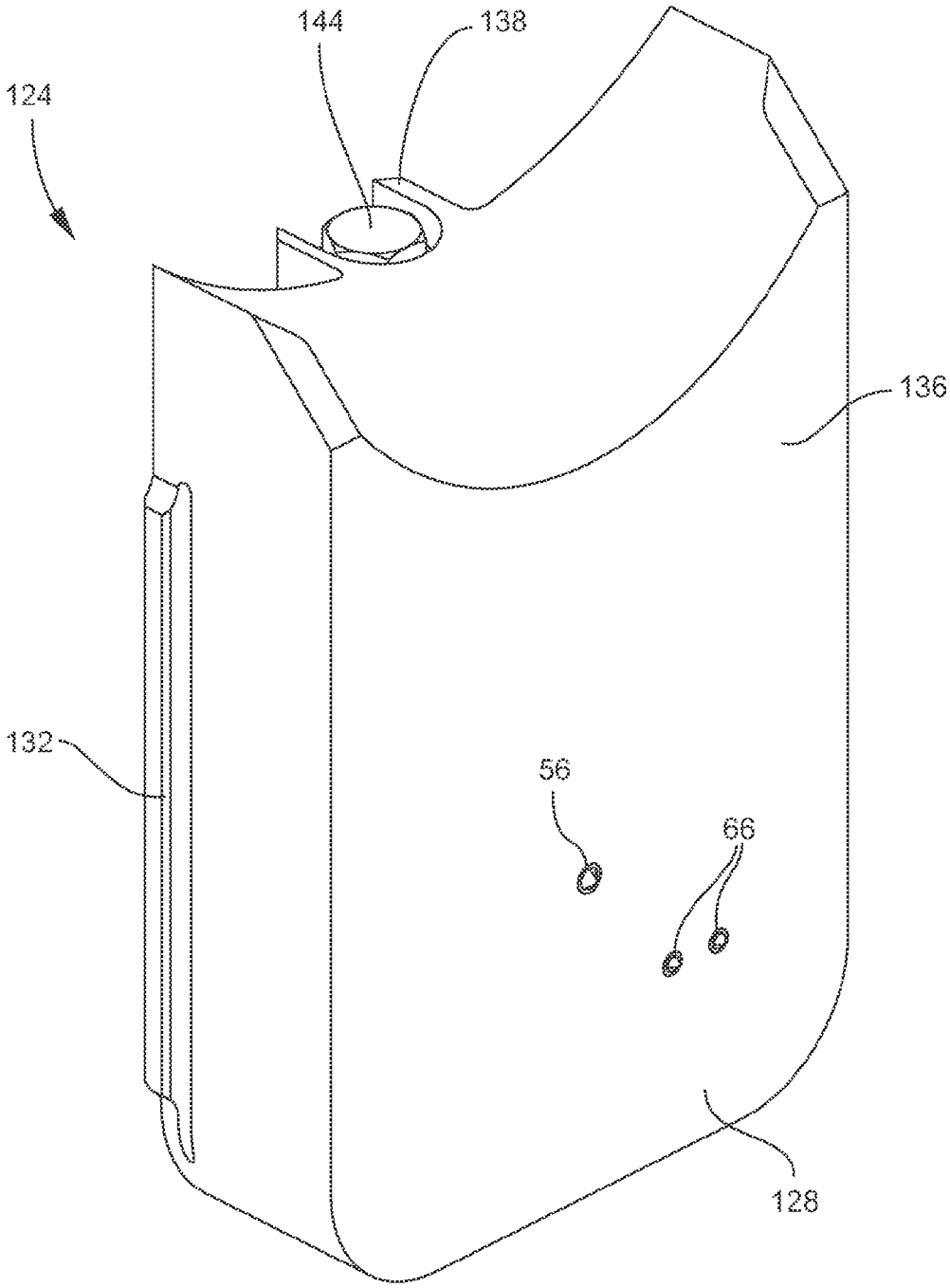
FIG. 13 is a front perspective view of the insert assembly of FIG. 10.

Insert assembly 124 includes muzzle and breech sides 128, 130 and opposing rails 132 for mating with opposing slots 134 (FIG. 12) in breechblock 122. The mating rails 132 and slots 134 prevent movement of insert assembly 122 along the central longitudinal axis A. Insert assembly 124 includes a main body 136. A firing pin module 50 (FIG. 8) and data link modules 52, 52 (FIG. 9) are disposed in the interior of insert assembly 124 and may be accessed by removing rear cover 74 (FIG. 14). As shown in FIGS. 10, 11 and 13, forward firing pin contact 56 and forward data link contacts 66 are biased through muzzle side 128 of insert assembly 124. As shown in FIG. 14, rear firing pin contact 60 and rear data link contacts 70 are biased through rear cover 74 of insert assembly 124. In the installed position of insert assembly 124 shown in FIG. 10, rear firing pin contact 60 contacts firing circuit contact 76 (FIG. 12) on breechblock 122 and rear data link contacts 70 contact data link contacts 78, 80 on breechblock 122.

The novel cannon breechblock insert assembly provides an easily accessible and compact package for both the firing contact and the data link contacts needed to fire smart munitions from cannons. The breechblock insert assembly enables the breechblock to be manufactured with many less stress-inducing machined features and fewer deep, tight tolerance holes. Unlike known breechblocks, the novel insert assembly with the firing pin and data link modules contained therein may be removed in either the open or closed position of the breechblock for faster and more efficient access for maintenance and replacement.

While the invention has been described with reference to certain embodiments, numerous changes, alterations and modifications to the described embodiments are possible without departing from the spirit and scope of the invention as defined in the appended claims, and equivalents thereof.

What is claimed is:

1. A breech assembly for a cannon having a barrel with a central longitudinal axis and a breech ring fixed to one end of the barrel, the breech assembly comprising:

a sliding breechblock disposed in the breech ring and translatable in the breech ring in a direction normal to the central longitudinal axis of the barrel;

an insert assembly disposed on a muzzle side of the breechblock and translatable in the breechblock in the direction normal to the central longitudinal axis, the insert assembly including a muzzle side, a breech side, and at least one electrical pin module, the insert assembly being removable from the breechblock without removing the breechblock from the breech ring; and mating portions formed on the breechblock and on the insert assembly that prevent displacement of the insert assembly with respect to the breechblock in a direction along the central longitudinal axis of the barrel.

2. The breech assembly of claim 1, wherein the at least one electrical pin module includes a firing pin module and at least one data link module.

3. The breech assembly of claim 2, wherein, in an installed position of the insert assembly in the breechblock, the firing pin module is substantially coaxial with the central longitudinal axis of the barrel.

4. The breech assembly of claim 3, wherein the mating portions include slots and rails that are parallel to the direction normal to the central longitudinal axis.

5. The breech assembly of claim 4, wherein the slots are formed in the breechblock and the rails are formed on the insert assembly.

6. The breech assembly of claim 5, further comprising at least one threaded fastener, which, when rotated in a first direction, fixes the insert assembly in the breechblock.

7. The breech assembly of claim 6, wherein the at least one threaded fastener displaces the insert assembly from the breechblock when rotated opposite to the first direction.

8. The breech assembly of claim 2, wherein the at least one electrical pin module includes a forward contact biased outwardly through the muzzle side of the insert assembly and a corresponding rear contact biased outwardly through the breech side of the insert assembly.

9. The breech assembly of claim 8, wherein the at least one electrical pin module includes a double-acting spring disposed between the forward and rear contacts.

10. The breech assembly of claim 9, wherein the insert assembly includes a removable cover on the breech side and the rear contacts penetrate the removable cover.

11. The breech assembly of claim 2, further comprising electrical contacts on the muzzle side of the breechblock that electrically connect with the firing pin module and the at least one data link module in an installed position of the insert assembly in the breechblock.

12. The breech assembly of claim 11, further comprising a flexible circuit board that contains the electrical contacts.

13. A breech assembly for a cannon having a barrel with a central longitudinal axis and a breech ring fixed to one end of the barrel, the breech assembly comprising:

a sliding breechblock disposed in the breech ring and translatable in the breech ring in a direction normal to the central longitudinal axis of the barrel:

an insert assembly disposed on a muzzle side of the breechblock and translatable in the breechblock in the direction normal to the central longitudinal axis, the insert assembly including a muzzle side, a breech side, a firing pin module and at least one data link module, the insert assembly being removable from the breechblock without removing the breechblock from the breech ring; and opposing slots formed on the breechblock and opposing rails formed on the insert assembly, the opposing rails being inserted into respective opposing slots to prevent displacement of the insert assembly with respect to the breechblock in a direction along the central longitudinal axis of the barrel;

wherein, in an installed position of the insert assembly in the breechblock, the firing pin module is substantially coaxial with the central longitudinal axis of the barrel.

14. The breech assembly of claim 13, wherein the opposing slots and opposing rails are parallel to the direction normal to the central longitudinal axis.

15. The breech assembly of claim 14, wherein the firing pin module and the at least one data link module each include a forward contact biased outwardly through the muzzle side of the insert assembly and a corresponding rear contact biased outwardly through the breech side of the insert assembly.

16. The breech assembly of claim 15, wherein the insert assembly includes a removable cover on the breech side and the rear contacts penetrate the removable cover.

17. The breech assembly of claim 13, further comprising a threaded fastener, which, when rotated in a first direction, fixes the insert assembly in the breechblock.

18. The breech assembly of claim 17, wherein the threaded fastener displaces the insert assembly from the breechblock when rotated opposite to the first direction.

19. The breech assembly of claim 13, further comprising electrical contacts on the muzzle side of the breechblock that electrically connect with the firing pin module and the at least one data link module in the installed position of the insert assembly in the breechblock.

20. The breech assembly of claim 19, further comprising a flexible circuit board that contains the electrical contacts.

* * * * *